US007668479B2

(12) United States Patent
Iwai

(10) Patent No.: US 7,668,479 B2
(45) Date of Patent: Feb. 23, 2010

(54) IMAGE FORMING APPARATUS HAVING INTERMEDIATE TRANSFER MEMBER

(75) Inventor: Katsutoshi Iwai, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 236 days.

(21) Appl. No.: 11/956,432

(22) Filed: Dec. 14, 2007

(65) Prior Publication Data

US 2008/0187342 A1 Aug. 7, 2008

(30) Foreign Application Priority Data

Feb. 1, 2007 (JP) ..... 2007-022763

(51) Int. Cl.
*G03G 15/16* (2006.01)
*G03G 15/01* (2006.01)

(52) U.S. Cl. ..... 399/101; 399/302

(58) Field of Classification Search ..... 399/101, 399/71, 302, 308
See application file for complete search history.

(56) References Cited

U.S. PATENT DOCUMENTS 7,215,896 B2 * 5/2007 Yamada et al.
7,376,365 B2 * 5/2008 Stahuber ..... 399/101
7,593,676 B2 * 9/2009 Katoh ..... 399/302
2006/0127124 A1 * 6/2006 Ota ..... 399/101
2007/0059007 A1 * 3/2007 Ai ..... 399/101
2008/0008489 A1 * 1/2008 Watanabe et al. ..... 399/71

FOREIGN PATENT DOCUMENTS

JP 61-277536 12/1986
JP 2002-323839 11/2002

* cited by examiner

*Primary Examiner*—Susan S Lee
(74) *Attorney, Agent, or Firm*—Cantor Colburn LLP

(57) ABSTRACT

An image forming apparatus includes: a primary transfer section which executes a first transfer by superimposing respective color toner images formed on a plurality of photoreceptors onto an intermediate transfer member; a secondary transfer section including a transfer roller, which concurrently transfers a plurality of toner images superimposed and formed on the intermediate transfer member onto a sheet conveyed from a sheet feed tray, which is in contact with the intermediate transfer member, and a high voltage power source which applies voltage to the transfer roller; and a controller which judges whether there is residual toner, which is a toner image formed onto the intermediate transfer member but not transferred onto the sheet when a sheet sensor detects the sheet exhaustion, and executes a cleaning mode in which the transfer roller is cleaned when there is the residual toner.

7 Claims, 9 Drawing Sheets

DISTANCE L1

DISTANCE L2

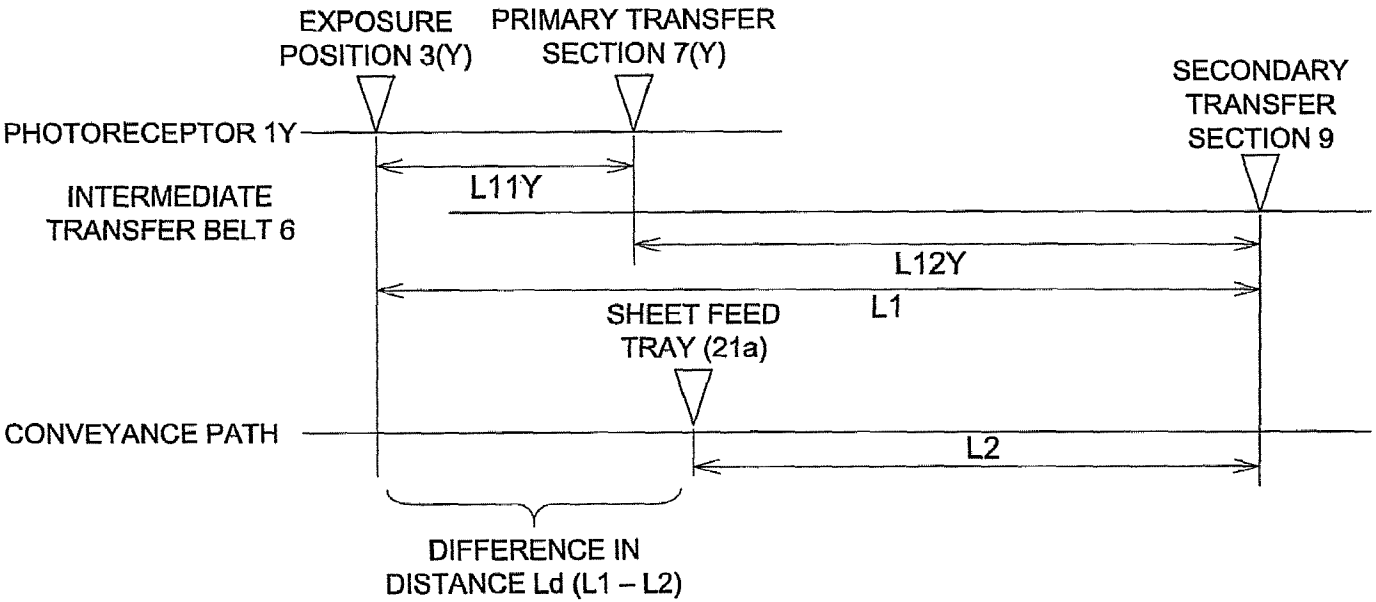
FIG. 5 ( a )
L1 > L2 (FULL COLOR MODE, SHEET FEED TRAY 21a)
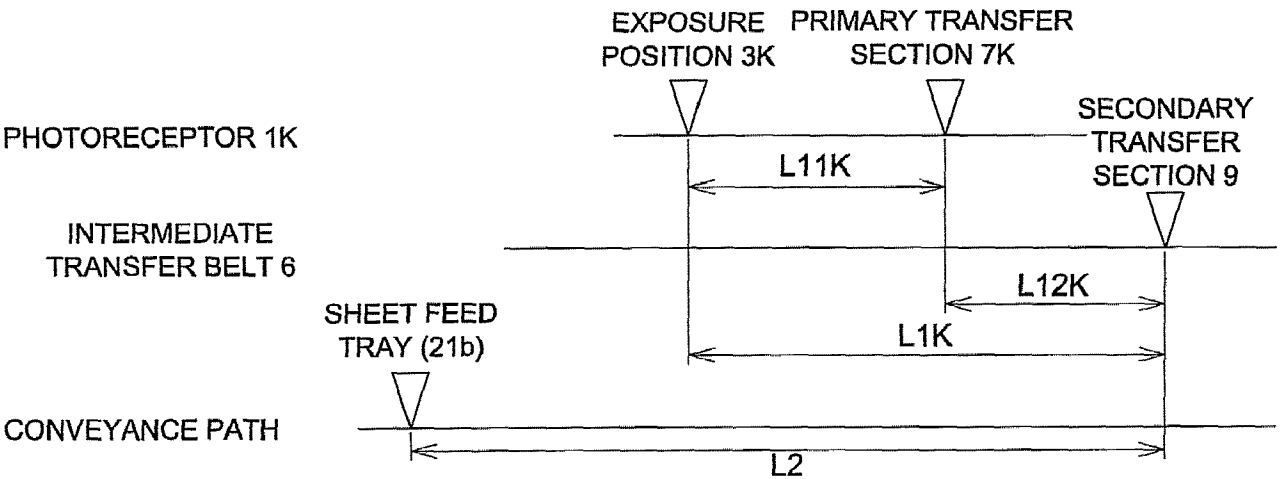
FIG. 5 ( b )
L1 ≤ L2 (MONOCHROME MODE, SHEET FEED TRAY 21b)

SHEET SENSOR 26

VOLTAGE APPLIED TO TRANSFER ROLLER 9a

IMAGE FORMING APPARATUS HAVING INTERMEDIATE TRANSFER MEMBER

This application is based on Japanese Patent Application No. 2007-022763 filed on Feb. 1, 2007, which is incorporated hereinto by reference.

BACKGROUND OF THE INVENTION

The present invention relates to image forming apparatuses, such as a copier, a facsimile machine and a printer of electro-photographic system, particularly relates to an image forming apparatus for transferring a toner image on a photoreceptor onto an intermediate transfer member and concurrently transferring the toner image having a plurality colors superimposed on the intermediate transfer member onto a sheet by a secondary transfer section.

There has been provided a tandem system color image forming apparatus among color image forming apparatuses of an electro-photographic system to realize a high-speed requirements in a high-speed trend in recent years. The tandem system color image forming apparatus forms toner images onto a plurality of photoreceptors, superimposes the toner images onto the intermediate transfer belt and concurrently transfers the superimposed toner images of a plurality of colors onto a sheet by a secondary transfer section.

In the tandem system color image forming apparatus having a certain type of mechanical structural disposal, there is a case that the distance from the place where starting image formation with the first toner color, for example, starting image formation with a Yellow color to the secondary transfer section, is longer than the distance from a sheet feed tray to the secondary transfer section.

In case of this mechanical structural disposal, at the time when the sheet is fed from the sheet feed tray, image formation has already started. At that time, even though the image formation is stopped after detecting the sheet exhaustion of the sheet feed tray, since the image formation has already started, the toner carried on the intermediate transfer member is not transferred to the sheet and resides on the intermediate transfer member as a residual toner. Further, the residual toner on the intermediate transfer member was transferred onto a secondary transfer roller and the transferred toner was retransferred onto the rear surface of sheets, which generates inconvenience, such as rear surface dirt.

If the number of sheet left in the sheet feed tray is accurately detected and the timing of sheet exhaustion is accurately determined, the occurrence of the residual toner can be avoided by stopping the image formation with that timing. However, accurately detecting the number of sheet left is practically difficult to achieve.

Unexamined Japanese Patent Application Publication No. 61-277536 disclosed a copier, which is arranged to start sheet feeding and image formation by delaying the sheet feeding timing and after confirming that sheet is not exhausted in case when the sheet left in the sheet tray becomes equal to less than a prescribed value as a countermeasure for those problems. Unexamined Japanese Patent Application Publication No. 2002-323839 discloses an image forming apparatus, which is arranged to prolong the sheet interval distance in case of continuous sheet feeding comparing with the normal situation so as to recognize the sheet exhaustion before starting exposure to the photoreceptor when having detected that the sheet left in the sheet tray becomes equal to less than a prescribed value.

However, according to the inventions of Unexamined Japanese Patent Application Publication Nos. 61-277536 and 2002-323839, since the distance between sheets widens when the sheet left in the tray is equal to less than a prescribed value, there is a problem that the productivity deteriorates after that until the sheet left becomes zero.

SUMMARY OF THE INVENTION

According to one embodiment of the present invention, a toner image forming apparatus, which forms an image on a sheet is provided with a plurality of exposure sections each for executing imagewise exposure based on image data, a plurality of photoreceptors each for forming an electrostatic latent image by imagewise exposure of the exposure section, an intermediate transfer member, onto which respective color toner images formed on the plurality of photoreceptors are transferred, a primary transfer section for executing a first transfer by superimposing respective color toner images formed on the plurality of photoreceptor onto the intermediate transfer member, a secondary transfer section for concurrently transfer a plurality of toner images superimposed and formed onto the intermediate transfer member onto a sheet conveyed from a sheet feed tray, the secondary transfer section including a transfer roller, which is in contact with the intermediate transfer member, and a high voltage power source for cleaning the transfer roller by applying voltage to the transfer roller, a sheet feed tray including a sheet sensor for detecting sheet exhaustion, and a controller for judging whether there is residual toner, which is a toner image formed onto the intermediate transfer member but not transferred onto the sheet when the sheet sensor detects the sheet exhaustion, and executing a cleaning mode for cleaning the transfer roller by applying bias voltage onto the transfer roller when there is the residual toner.

BRIEF DESCRIPTION OF THE DRAWINGS

FIGS. 5(*a*)-5(*b*) illustrate an explanation drawing for showing the relationship of the each selection condition of an image forming mode and a sheet feed tray, and the length relationship between the distances L1 and L2.

DETAILED DESCRIPTION OF THE PREFERRED EMBODIMENT

The present invention will be described based on an embodiment. However, the present invention is not limited to the embodiment.

Figure 1:
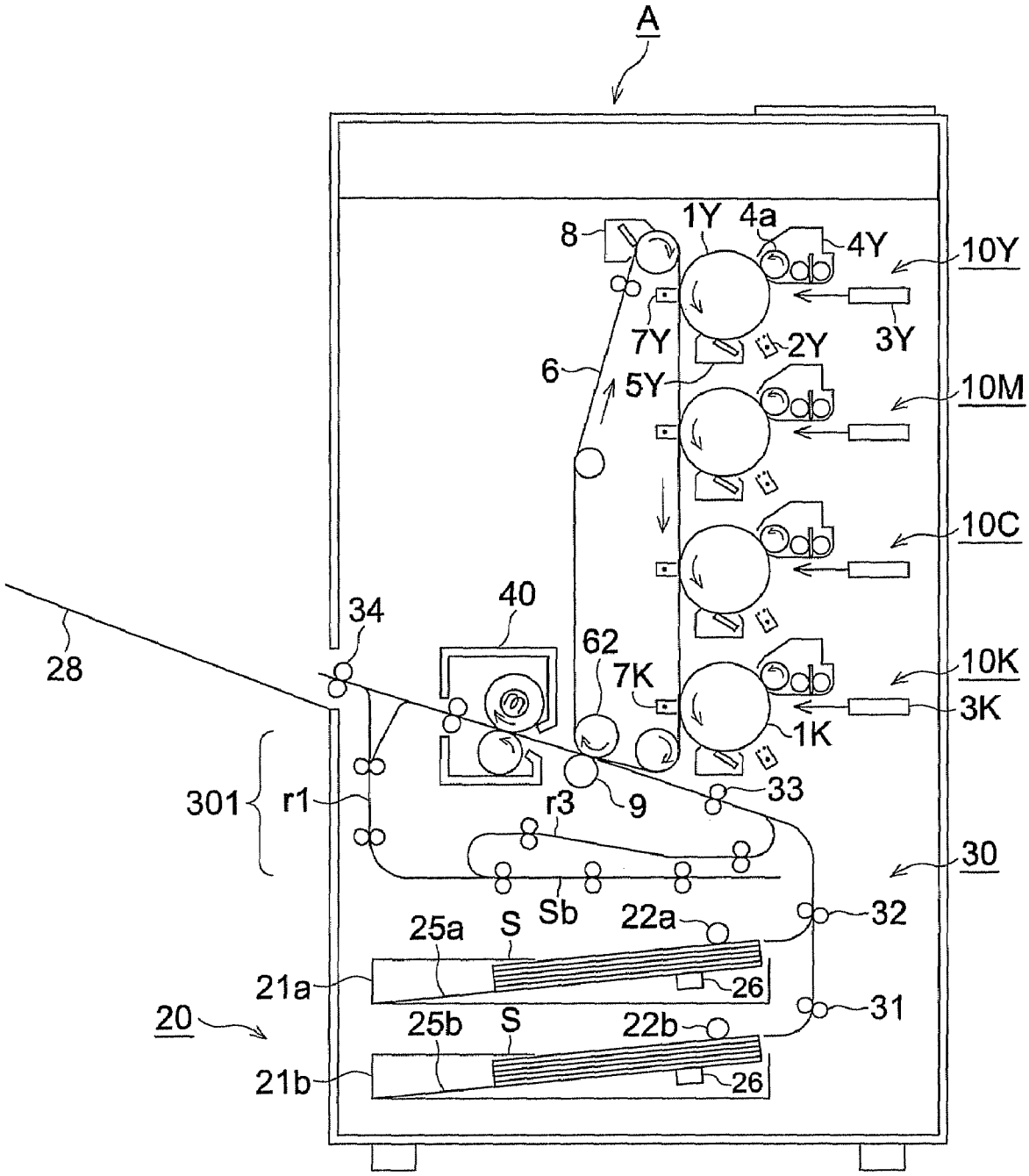
FIG. 1 illustrates a main portion of an image forming apparatus pertaining to an embodiment of the present invention.

FIG. 1 illustrates a main portion of an image forming apparatus pertaining to an embodiment of the present invention. An image forming apparatus A is an image forming apparatus called a tandem type color image forming apparatus, which is configured by a plurality of image forming sections 10Y (Yellow), 10M (Magenta), 10C (Cyan) and 10K (Black), an intermediate transfer belt 6 having a belt shape as an intermediate transfer member, the secondary transfer section 9, a sheet feed unit 20 and a fixing apparatus 40.

A sheet feed unit 20 is configured by a plurality of sheet feed trays 21*a* and 21*b*. A sheet S stored in the sheet feed tray 21 is conveyed by a conveyance section 30 configured by rollers 31, 32 and 33.

An image forming section 10 of each color is configured by a photoreceptor 1, a charging section 2, an exposure section 3, a developing section 4, a cleaning section 5 and a primary transfer section 7. Since the mechanical configuration of the image forming section 10 of each color is the same, reference symbols are put on the structure of a yellow system in the FIG. 1 and the symbols of other color systems, such as M (Magenta), C (Cyan) and K (Black) are omitted.

The developing section 4 respectively stores one-component developer or two-component developer of colors of Yellow (Y), Magenta (M), Cyan (C) and Black (K), which have been charged with the same polarity as the charged polarity of the photoreceptors and includes a developing roller 4*a* formed by a non-magnetic stainless or aluminum material shaped into a cylindrical shape having for example thickness of 0.5-1 mm and the outer diameter of 15-25 mm. The spacing roller (not shown) keeps space between the developing roller 4*a* and the photoreceptor 1, for example, 100-1000 μm and rotates as the same rotational direction as the rotation of the photoreceptor 1. Reversal development against the exposed area on the photoreceptor 1 is conducted by applying developing bias voltage of direct current voltage or direct current voltage onto which alternate current voltage has been superimposed, which has the same polarity (minus polarity in the embodiment) as that of toner, against the developing roller 4*a* when developing. With respect to the toner used for the reversal development, styrene acryl polymerization toner having a small particle diameter is used.

The intermediate transfer belt 6 is formed by an endless belt having a volume resistivity of $10^6$-$10^{12}$ Ω·cm, for which a resin material, such as, polycarbonate (PC), polyimide (PI), polyamideimide (PAI), polyvinylidenefluoride (PVDF), tetrafluoroethylene-ethylene-copolymers (ETFE), rubber material, such as, EPDM, NBR, CR and Polyurethane, into which conductive filler, such as, carbon is dispersed or ionized conductive material is included, is used. It is preferable that the thickness of the endless belt is set about 50-200 μm in case of resin material and 300-700 μm in case of rubber material.

[Image Forming Process]

At the same time as a start signal of image formation, the photoreceptor 1Y starts rotating counterclockwise as shown in an arrow associated with the startup of a drive motor (not shown). At the same time, a charging section 2Y starts charging onto the surface of the photoreceptor 1Y.

After the photoreceptor 1Y is charged, the exposure section 3Y starts image writing of an image corresponding to the image data of "Y" and an electrostatic latent image corresponding to original document image of "Y" is formed onto the photoreceptor 1Y.

The electrostatic latent image is reversibly developed by the developing section 4Y of "Y" in a non-contact state and a toner image of "Y" is formed onto the photoreceptor 1Y according to the rotation of the photoreceptor 1Y. The toner image of "Y" formed on the photoreceptor 1Y is transfer onto the intermediate transfer belt 6 by the primary transfer section of "Y". After that, the residual toner on the photoreceptor 1Y is cleaned by a photoreceptor cleaning section 5. Then the photoreceptor 1Y enters into the next image formation cycle.

Next, an exposure section 3M executes image writing of the image corresponding to the image data of "M", which is color signal of "M" (Magenta). And, an electrostatic latent image corresponding to the original document image of "M" on the surface of the photoreceptor 1M is formed on the surface of the photoreceptor 1M. The electrostatic latent image becomes a toner image on the photoreceptor 1M by a developing section 4M of "M". In the primary transfer section 7 of "M", the electrostatic latent image is synchronized with the toner image of the "Y" on the intermediate transfer belt 6 and superimposed onto the toner image of "Y".

By the same process, a toner image of "C" (Cyan) is synchronized with the toner image, onto which "Y" and "M" have been super imposed, and superimposed onto the toner image, onto which "Y" and "M" have been super imposed in the primary transfer section 7 of "C". Next, a toner image of "K" is synchronized with the formed toner image, onto which "Y", "M" and "C" have been superimposed in the primary transfer section 7K of "K", and superimposed onto the formed toner image, onto which "Y", "M" and "C" have been superimposed to form the color toner image onto which "Y", "M", "C" and "K" are superimposed.

The intermediate transfer belt 6, onto which a superimposed color toner image is carried, is conveyed clockwise. A sheet S stored in the sheet feed tray 21*b* of the sheet feed unit 20 is fed by the first sheet feeding section 22*b*, conveyed to a secondary transfer section 9 via conveyance rollers 31 and 32 and a registration roller 33. The superimposed color toner image is concurrently secondary transferred onto the sheet S.

After that, the intermediate transfer belt 6 runs. The residual toner on the intermediate transfer belt 6 is cleaned by a belt cleaner 8 to enter the next image formation cycle.

The sheet S, onto which the superimposed color toner image has been transferred, is conveyed to the transfer apparatus 40, nipped by a heat roller and a pressing roller, and the color toner image is fixed thereon. The sheet S, onto which the toner image has been fixed, is conveyed to the outside of the apparatus by the conveyance roller 28 and placed onto an ejection plate 28.

Numeral 301 denotes a dual surface conveyance path, which is configured by an introduction conveyance path r1, a switch back conveyance path sb and a merging conveyance path r3. In case when executing dual face image formation, the sheet, onto which an image has been formed in one surface of the sheet, is reversed by being switched back in the dual surface conveyance path 301 and merged into the conveyance path of single surface by the registration roller 33 again. Then a toner image is transferred onto the rear surface of the sheet S at the secondary transfer section 9. The sheet is conveyed to outside the apparatus via the fixing section 40 and conveyance roller 24.

A top surface detection sensor (not shown) for detecting the top surface of the sheets stored in the sheet feed tray 21 is provided. The height of a storing tray 25*a*, onto which the sheet S is placed, is adjusted by the drive of a driving motor (not shown) so that a sheet feed roller 22*a* touches the top surface of the sheets. Numeral 26 is an optical system sheet sensor for detecting the exhaustion of the sheet stored in the sheet feed tray 21.

[Secondary Transfer Section]

Figure 2:
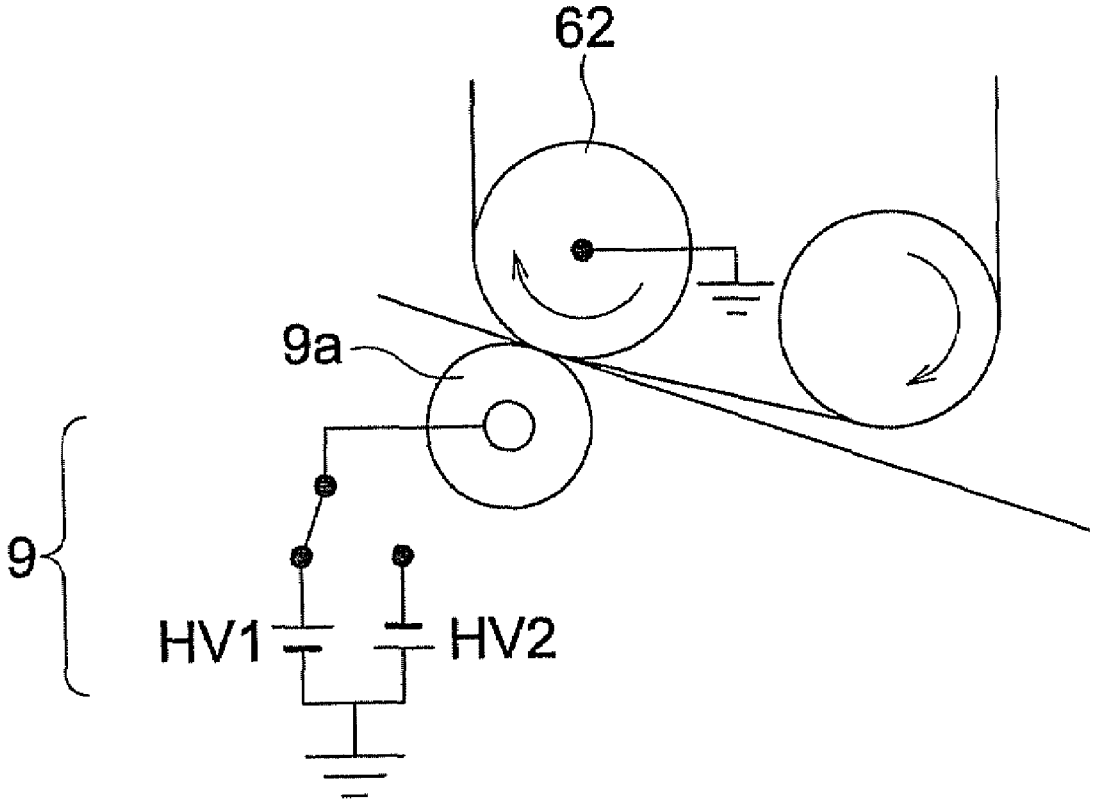
FIG. 2 illustrates a schematic diagram of a secondary transfer section 9.

FIG. 2 illustrates a schematic diagram of the secondary transfer section 8, which is shown by magnifying the surrounding area of the secondary transfer section in FIG. 1. The secondary transfer section 9 includes a secondary transfer roller 9*a* and a high voltage source HV1. The secondary transfer roller 9*a* is formed by coating the circumference surface of the conductive shaft metal, such as stainless steel having a diameter of, for example, 8 mm, with a semi-conductive elastic rubber having a volume resistivity of $10^6$-$10^9$ Ω·cm, thinness of 5 mm and a rubber solidity of 20°-70° (Asker—C), which is a solid state or an expanded sponge state and formed by inputting a conductive filler, such as carbon or the ionized conductive material into a rubber material such as Polyurethane, EPDM and silicon. Since the secondary transfer roller 9*a* contacts toner, semi-conductive fluorine resin or a urethane resin, which has an excellent separation characteristic is coated on the surface of the secondary transfer roller.

A backup roller 62 is formed by coating the circumference surface of the conductive shaft metal of stainless steel with a semi-conductive material having a thickness of 0.05-0.5 mm, which is formed by the rubber or resin material, such as, polyurethane, EPDM, and silicon rubber, into which a conductive filler, such as, carbon or ionized conductive material is included.

The secondary transfer roller 9*a* is provided so as to press the backup roller 62 with a prescribed pressing force against the elasticity of an elastic body layer. In this embodiment, a transfer nip section having a width of several mm, for example, 3 mm is formed between the second roller 9*a* and the backup roller 62.

A controller is arranged to control a high voltage source HV1 so as to input a transfer voltage having an opposite polarity of the toner polarity to the conductive shaft metal of the secondary transfer roller 9*a*. In this embodiment, since when a normal image formation, the toner polarity is minus polarity, the controller controls the high voltage source HV1 to input the voltage having plus polarity to the secondary transfer roller 9*a*. Further, the controller is arranged to control the high voltage source HV2 to input a cleaning voltage having the same polarity as the polarity of toner to the secondary transfer roller 9*a* in case of cleaning mode. It is preferable to execute the cleaning mode by alternatively inputting the voltages of the high voltage source HV1 and the high voltage source HV2 to the secondary transfer roller 9*a*.

Meanwhile, in the embodiment, an example using the transfer roller has been described. However, the embodiment is not limited to this example. A transfer belt may be used. At that time, in the cleaning mode, when inputting bias voltage from the high voltage source, cleaning may be conducted by using a cleaning brush at the same time.

Figure 3:
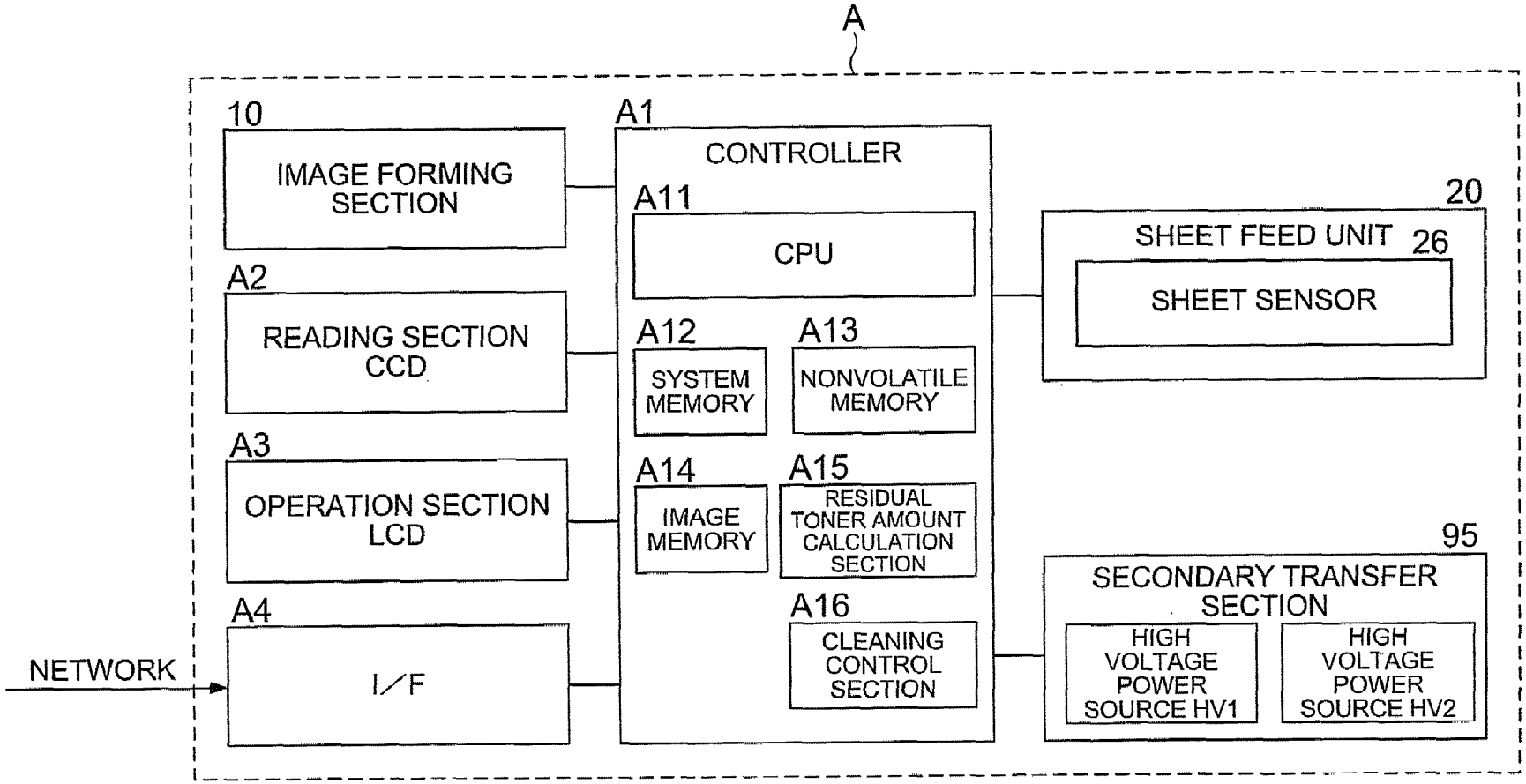
FIG. 3 illustrates a block diagram showing control system of the image forming apparatus of the embodiment.

FIG. 3 illustrates a block diagram showing control system of the image forming apparatus of the embodiment. In FIG. 3, the surroundings of the portion necessary for explaining the operations of the embodiment is mainly illustrated and the other portion, which is well known as an image forming apparatus, is omitted.

"A" denotes an image forming apparatus for executing image formation onto a sheet S based on image data. The image forming apparatus "A" is configured by a controller A1 for conducting various controls, a reading section A2 for reading an original document by a CCD (Charge Coupled Device), an operation section LCD A3 formed by a LCD (Liquid Chrystal Display) for displaying various displays of the apparatus and an operation section, by which various input operations are conducted, an I/F (interface) A4 as a communication section for conducting communications via network, an image forming section 10, a sheet feed unit 20 and a secondary transfer section 95.

In FIG. 3, the controller A1 is configured by a CPU A11 for controlling various sections, a system memory A12, a nonvolatile memory A13, an image memory A14 and a residual toner amount calculation section A15 and a cleaning control section A16.

The CPU A11 executes the programs stored in the system memory A12 to conduct various controls. The nonvolatile memory A13 stores the sheet sizes of fixed forms, the length of the paths between various structural unit (the distances between the sheet feed unit and the secondary transfer section and an exposure position) of the apparatus and a toner mass per a dot (adhesive amount). Further, the image memory A14 memorizes the image data, which has been inputted via the reading section A2 or the I/F (A4).

Various input operations of a user are conducted from the operation section LCD A3. The original document is read by the reading section A2 and stored in the image memory A14 based on the input contents. The image forming section 10 executes image formation based on the stored image data. When conducting an input operation, selection of the sheet feed tray 21 for feeding sheets and an output mode (color, monochrome) are set.

The cleaning control section A16 controls the secondary transfer section 95. The operations of the residual toner amount calculation section A15 and the cleaning control section A16 will be described later.

[Calculation of Distances L1 and L2]

Calculation methods of a distance L1 of an image formation path pertaining to the image formation in the controller and a distance L2 of a conveyance length pertaining to sheet conveyance will be described hereinafter.

Figure 4:
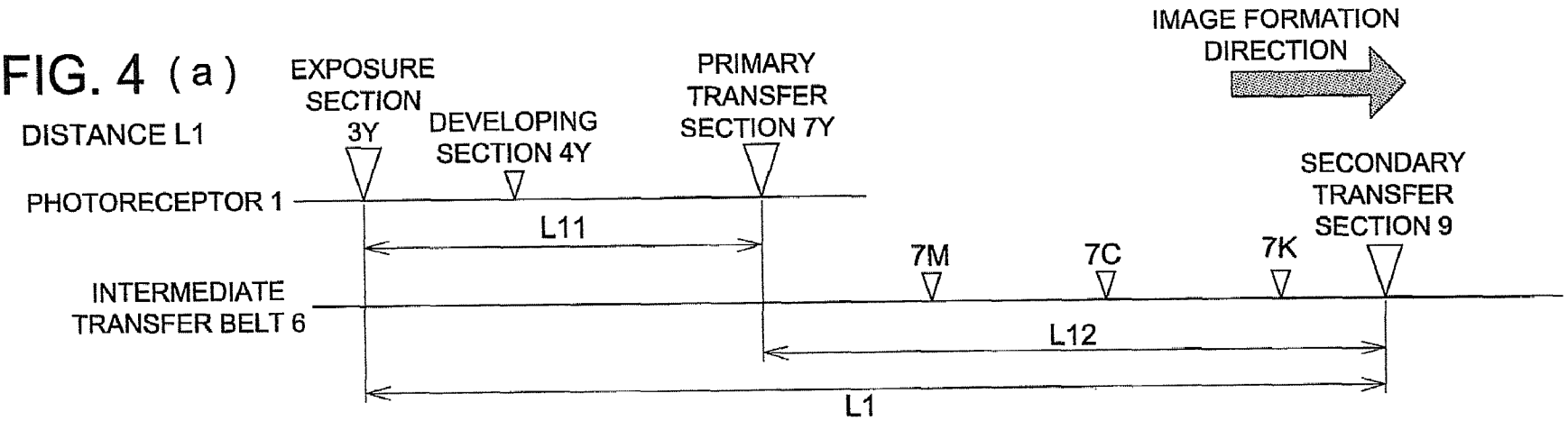
FIGS. 4(*a*)-4(*b*) illustrate an explanation drawing for showing relationship of distances L1, L2 and respective mechanical structures.
Figure 4:
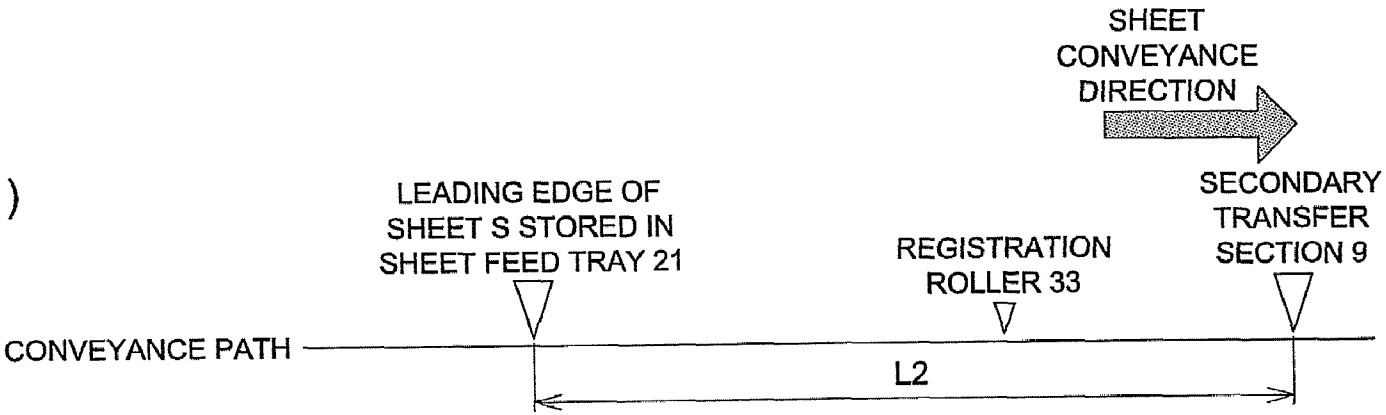

FIGS. 4(*a*)-4(*b*) illustrate an explanation drawing for showing relationship of distances L1, L2 and respective mechanical structures. FIGS. 4(*a*)-4(*b*) are notation drawings, in which the path of the image forming apparatus illustrated in FIG. 1 has been extended on a straight line along the flow of the image formation and sheet conveyance.

FIG. 4(*a*) is illustrated for explaining a calculation method of the distance L1 pertaining to the image formation path. In FIG. 4(*a*), L11 denotes a distance of a circumference surface of the photoreceptor 1 from the exposure position by the exposure section 3 on the photoreceptor 1 to the primary transfer section 7. L12 denotes a distance from the primary transfer section 7 to the secondary transfer section 9 of a circumference surface of the intermediate transfer member 1. And a distance L1 is a distance obtained by adding L11 and L12.

FIG. 4(*b*) is illustrated for explaining a calculation method of the distance L2 pertaining to the image formation path. The distance L2 denotes the distance from the leading edge of the sheet stored in the sheet feed tray 21 to the secondary transfer section 9. The distance L1 varies according to the image forming mode and the distance L2 varies according to the position of the selected sheet feed tray. Namely, the length relationship between distances L1 an L2 varies according to the image forming mode and the selection of the sheet feed tray. It will be explained by using FIGS. 5(*a*)-5(*d*).

FIG. 5(*a*) illustrates the length relationship between distances L1 and L2 under the condition that the image forming mode is a full color mode and the selected sheet feed tray is the first sheet tray 21*a*. The reference symbols in FIG. 5(*a*) correspond to the image forming apparatus illustrated in FIG. 1.

In FIG. 5(*a*), in the case of the full color mode, with respect to the distance L1, the distance from the exposure position on the photoreceptor 1Y by the exposure section 3Y of Yellow color, which is the farthest distance to the secondary transfer section 9 in the plurality of exposure sections 3 is calculated. The distance L2 is a distance from the sheet feed tray 21*a* to the secondary transfer section 9.

Under these conditions, as illustrated in FIG. 5(*a*), the distance relationship between the distances L1 and L2 becomes L1>L2. Thus the image formation (image exposure from the exposure section 3Y to the photoreceptor 1Y) is to start before the timing of starting the conveyance of the sheet from the sheet feed tray 21*a*.

Namely, at the time when the sheet sensor 26 detects the sheet exhaustion of the sheet feed tray 21*a*, the image formation of the area, which corresponds to the differential distance Ld obtained by subtracting L2 from L1, has already started. The toner corresponding to the area of the differential distance Ld is not transferred to the sheet and all of the toner becomes "residual toner". Thus execution of the cleaning mode becomes necessary against the residual toner.

FIG. 5(*b*) illustrates the length relationship between distances L1 and L2 under the condition that the image forming mode is a monochrome mode and the selected sheet feed try is the second sheet tray 21*b*.

In the case of a monochrome mode (Black), the distance L1 is a distance from the exposure position on the photoreceptor 1K by the exposure section 3K to the second exposure section 9. Since comparing with L12Y illustrated in FIG. 5(*a*), a distance L12K is shorter than the distance L12Y, the distance L1 becomes short. The distance L2 is a distance from the sheet feed tray 21*b* to the secondary transfer section 9.

Under these condition, as illustrated in FIG. 5(*b*), the relationship between the distances L1 and L2 becomes L1≦L2. Thus, the image formation can be started after having started the sheet conveyance from the sheet feeding tray 21*b*, namely, after confirming that there is a sheet in sheet feeding tray 21*b*. In this case, the distance L2 is a distance from the sheet feed tray 21*b* to the secondary transfer section 9.

Meanwhile, the distances between respective mechanical structures are stored in the nonvolatile memory in advance. By referring to these data, the CPU (A11) in the controller A1 calculates the distances L1 and L2.

[Residual Toner Amount Calculation]

Next, the calculation of the residual toner amount by a residual toner amount calculation section A15 of the controller will be explained. Under the condition of L1>L2 as illustrated in FIG. 5(*a*), in case when the sheet sensor 26 has detected the sheet exhaustion, "residual toner", which is not transferred to a sheet, occurs. The residual toner amount calculation section A15 of the controller A1 calculates the residual toner amount.

"Residual toner amount" denotes a toner amount, which is not transferred onto the sheet, in the area, to which image formation has already been executed. The calculation of the residual toner amount is conducted by multiplying "a toner amount per a dot" to "the number of dots of outputted image data".

The "the number of dots of outputted image data" can be obtained by specifying the image area corresponding to the area of the differential distance Ld, which is obtained by subtracting L2 from L1, and multiplying the number of dots of the image data corresponding to the specified area. For example, in case when conducting continuous sheet feed of A4 size (conveyance length is 210 mm) with a sheet interval of 70 mm, in case the differential distance Ld is 190 mm, 120 mm (190 mm-70 mm), which is about 60% of the image area from the leading edge of the A4 size image, is going to be a calculation base of the "the number of image dots of outputted image data". Further, in case when the differential distance Ld is 280 mm-350 mm, 210 mm, which is an image area of a A4 size sheet, is going to be the calculation base of "the number of dots of outputted image data". Here, 350 mm is a length obtained by summing the sheet intervals of the leading edge side and rear edge side (each 70 mm) of the conveyance length of 210 mm.

"A toner amount per dot" of the latter denotes a toner mass per a dot of the toner image developed on the intermediated transfer belt 6. The conversion table is stored in the nonvolatile memory A13 for each color in advance. In case when the environmental temperature and the environmental humidity of the surrounding of the image forming apparatus A change, the conversion table of "a toner amount per dot" corresponding to the environmental temperature and the environmental humidity may be stored so that the toner mass becomes a toner mass corresponding to the change amount.

In case that the image density (image resolution) of the image forming apparatus is, for example, 600 dpi (dot per inch), the image area corresponding to the differential distance Ld is a page of A4 size sheet and the image area ratio (of total four colors) of the image data corresponding to the image area is 100%, the number of dots is 34.8 Mega dots. And, the image density of the image forming apparatus is 600 dpi, the toner mass per a unit area of toner is 7 g/m$^2$, the toner mass per one million dots is about 12.5 mg/Mdot. Thus, the calculation result of the residual toner amount becomes 435 mg, which is derived by multiplying the "a toner mass per a dot" to "the number of dots of outputted image data" (=34.8×12.5).

[Control Flow]

Figure 6:
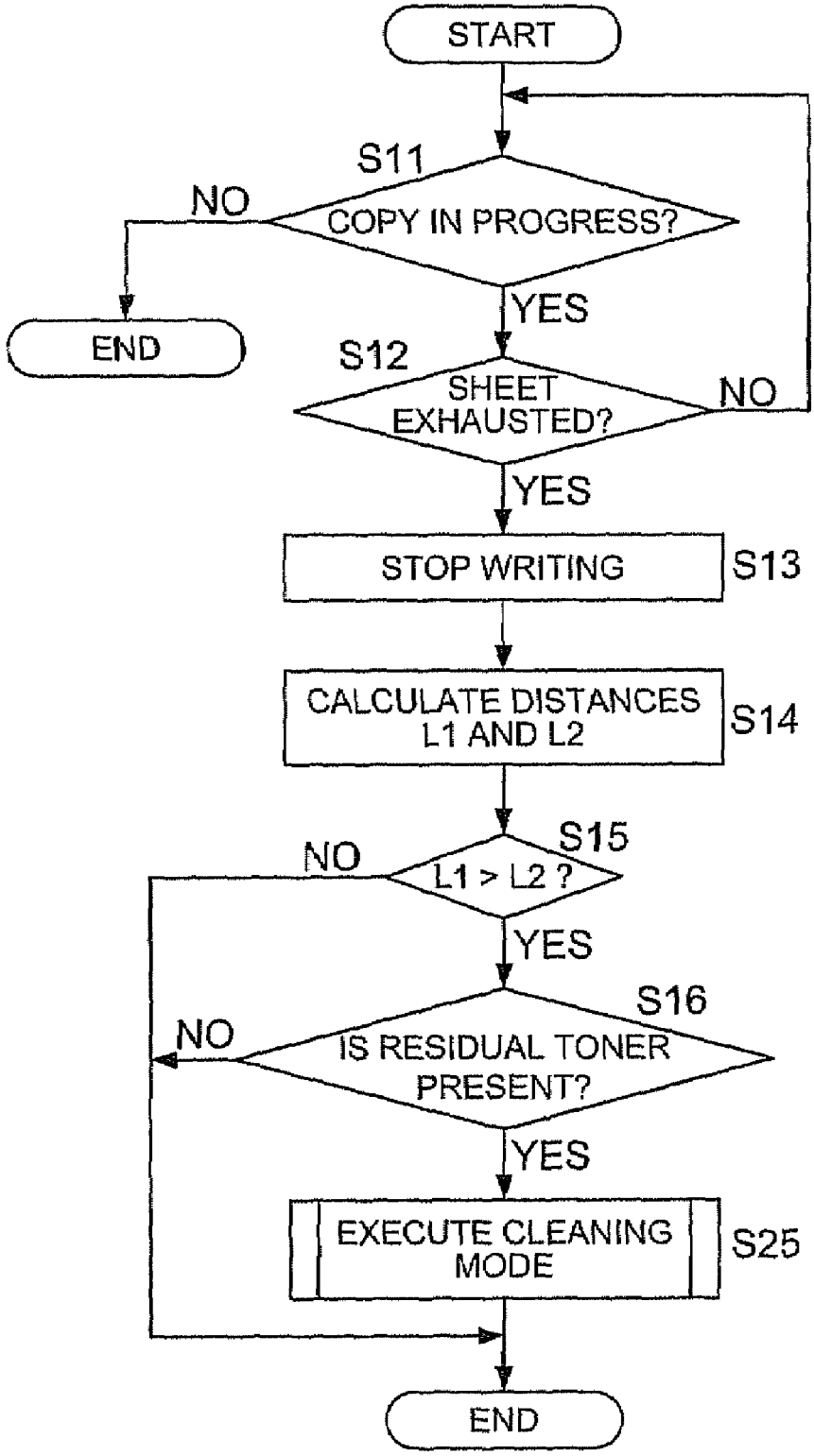
FIG. 6 illustrates a flowchart showing the operation of image forming apparatus pertaining to the embodiment.

FIG. 6 illustrates a flowchart showing the operation of image forming apparatus pertaining to the embodiment. Firstly, in STEP S11, in case of under image formation (under copying), the controller A1 determines whether or not sheet exhaustion in the sheet feed tray 21 for conveying the sheets has occurred by using signals of the sheet sensor 26 in the next STEP S12.

In case when the sheet exhaustion does not occur (STEP S12: No), the image formation will be continued until all image formation pertaining to the print jobs finishes. Meanwhile, in case when the sheet exhaustion occurs (STEP S12: Yes), writing to the photoreceptor 1 by the exposure section 3 is stopped (STEP S13).

In this case, in the case when there a sheet feed tray having a shorter conveyance path to the secondary transfer section 9 than that of the sheet feed tray, in which the sheet exhaustion occurred, and the sheet stored in the sheet tray is the same size sheet stored in the sheet tray, in which the sheet exhaustion occurred, switching of the sheet feed tray may be conducted even under the continuous sheet feeding operation. For example, this is the case that sheet feed trays 21*a* and 21*b* store the same A4 size sheets and sheet exhaustion occurs in the sheet feed tray 21*b*, and sheet feed tray change to a sheet feed tray 21*a* having a shorter conveyance path than the sheet feed tray 21*b* is conducted. In this case, even though the sheet exhaustion occurs, since automatic sheet feed tray switching can be conducted so as not to generate the "residual toner", the control flow of STEPS 13 onward can be omitted.

In STEPs S14 and S15, the controller A1 calculates the distances L1 an L2 and compares the lengths of both of them according to the explanation in FIGS. 4(*a*)-4(*b*). The calculation of the distance L1 is conducted based on the information of the image forming mode (full color, monochrome) obtained when starting the image formation. The calculation of the distance L2 is conducted based on the information of the position of the sheet feed tray for conducting a sheet feed operation. In case when L1>L2 is not satisfied (STEP S15: No), since the "residual toner" is not generated, the process ends.

Meanwhile, the distance calculated based on the image forming mode used in the image formation and the sheet feed tray satisfies L1>L2 (STEP S15: Yes), and the controller A1 has determined that there is residual toner image (STEP S16: Yes) as a result of the determination whether or not there is existence of residual toner, "the toner image of the residual toner being formed onto the intermediate transfer member 6 and the residual toner amount being not transferred onto the sheet when the sheet sensor 26 has detected the sheet exhaustion", a cleaning mode is executed (STEP S25) and the process ends. The cleaning mode will be described later.

"The toner image formed onto the intermediate transfer member" denotes a notation including the toner image, which has been already formed onto the intermediate transfer member 6 at the time when the sheet sensor 26 detects the sheet exhaustion and in addition, the toner image, which has been written onto the photoreceptor 6 by the exposure section 3 and will be formed onto the intermediate member 6 thereafter.

[Execution of Cleaning Mode]

Figure 7:
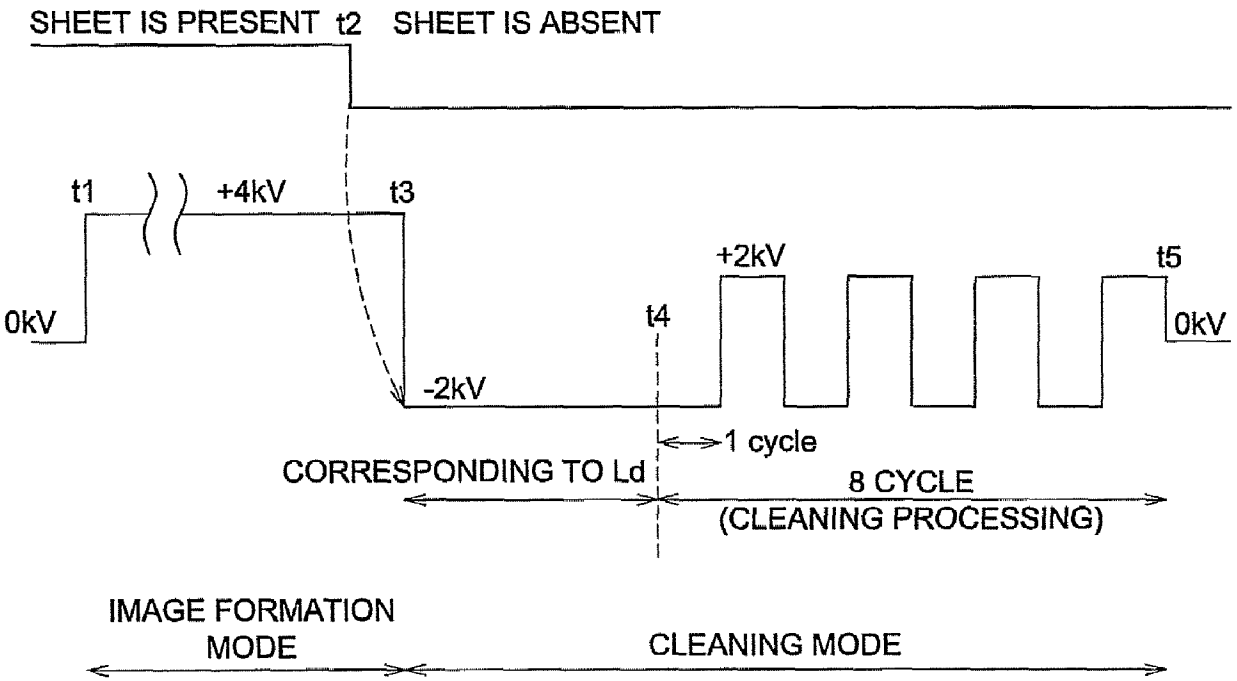
FIGS. 7(*a*)-7(*b*) illustrate a sequence chart for explaining the execution of a cleaning mode.

FIGS. 7(*a*)-7(*b*) illustrate a sequence chart for explaining the execution of a cleaning mode. FIG. 7(*a*) illustrates ON/OFF signal of the sheet sensor 26, and FIG. 7(*b*) illustrates the output of the high voltage sources HV1 and HV2 to be applied onto the transfer roller 9*a*. A plus voltage output (for example +2 kV) of the high voltage source is applied by the high voltage source HV1 and the minus voltage output (for example −2 kV) of the high voltage source is applied by the high voltage source HV2. The cleaning control section A16 of the controller A1 conducts a switching control of the outputs so as to output "alternative voltage" by alternatively outputting the outputs of both voltage sources (for example, a time period from time t4 to time t5).

At the time of t1 in the FIGS. 7(*a*) and 7(*b*), image formation is conducted. And, +4 kV voltage, which is opposite polarity of the toner, is applied onto the secondary transfer roller 9*a* to secondarily transfer the toner image formed on the intermediate transfer belt 6 onto the sheet. At the time of t2, while image formation is conducted, the signals of the sheet sensor 26 change from a "sheet-exist" state to a "sheet-exhaust" state. In accordance with this change, as described above, "residual toner" is generated. Time t3 is a time when the residual toner on the intermediate transfer belt 6 reaches to the secondary transfer section 9 after a prescribed time (which corresponds to distance L1) has passed from the time t2.

The time period from the time t3 to time t4 corresponds to the differential distance Ld. Within this period, the residual toner on the intermediate transfer belt 6 pass through the secondary transfer section 9. Since the residual toner on the intermediate transfer belt 6 touches the secondary transfer roller 9*a*, the residual toner shifts from the intermediate transfer belt 6 to the surface of the secondary transfer roller 9*a*. Since this shifted toner becomes a cause of the dirt of the rear surface of a sheet in the case of image formation if nothing is applied to the shifted toner, the shifted toner needs to be removed by executing cleaning. In the period from the time t3 to time t4, in order to regulate the shift of residual toner to the transfer roller 9*a*, voltage of −2 kv, which is the same polarity as that of toner, is applied onto the transfer roller 9*a*.

In the period from time t4 to time t5, the alternative voltage is applied to the transfer roller 9*a* to shift back the residual toner shifted onto the surface of the transfer roller 9*a* to the intermediate transfer belt 6 again. The alternative voltage is to be switched with a constant cycle, which has been set equal to or more than the time necessary to rotate the transfer roller 9*a* for one turn. For example, in case that the roller outer diameter of the transfer roller 9*a* is 18 mm (outer circumference 56.5 mm) and the circumference velocity (sheet conveyance velocity) 250 mm/sec, the time necessary to rotate the transfer roller 9*a* for one turn is 226 msec. Thus, one cycle for switching the polarity (it will be named a rotation cycle hereinafter) is set about 226 msec.-240 msec. This will be conducted for 8 rotation cycles. In this embodiment, an example, in which a constant voltage source for outputting a constant voltage is used, has been described. However, the embodiment is not limited to this example. A high voltage source, which supplies a constant current output for keeping a const current, may be used to output a constant current.

As described above, by arranging an image forming apparatus so as to determine the existence of the residual toner, which will be a toner image to be formed on the intermediate transfer member and will not be transferred onto a sheet in case when having detected the sheet exhaustion while forming an image, and stops the image formation to execute a cleaning mode when determined that there is residual toner, an image forming apparatus, which is capable of preventing the deterioration of productivity and avoiding the inconvenience by the residual toner due to the sheet exhaustion in the sheet feed tray, can be obtained.

[Change of Execution Conditions of Cleaning Mode Based on Residual Toner Amount]

Figure 8:
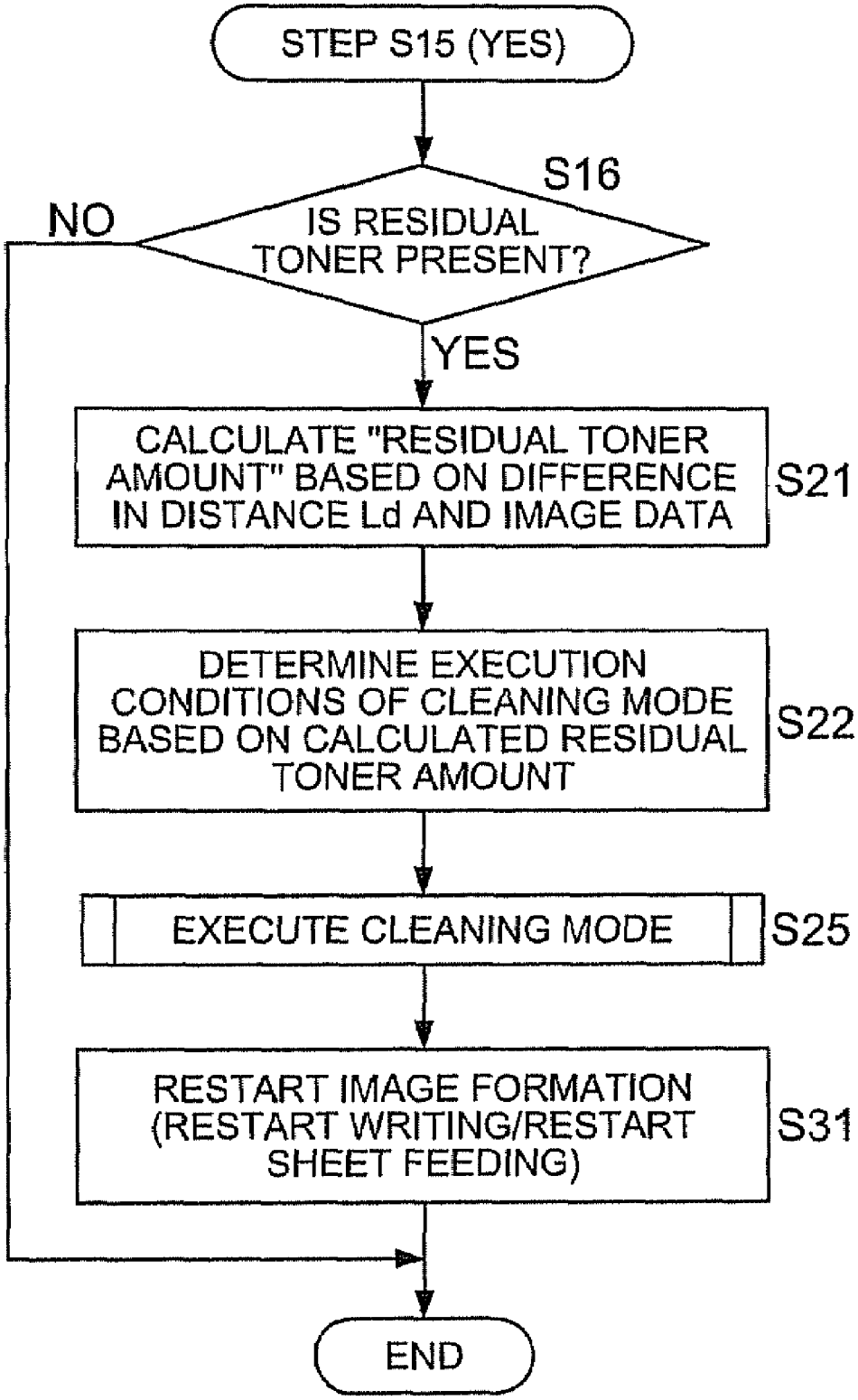
FIG. 8 illustrates a flowchart for explaining the operation of the image forming apparatus pertaining to the other embodiment.

FIG. 8 illustrates a flowchart for showing the operation of the image forming apparatus pertaining to the other embodiment. In FIG. 8, since the steps prior to STEP 16 are the same as FIG. 6, the explanation will be omitted. In STEP S21, the residual toner amount is calculated based on the differential distance Ld and the image data (number of dots). In STEP S22, the controller A1 changes and controls the execution condition of a cleaning mode based on the residual toner calculated in STEP S22. Here, the procedure of determining the execution condition of the cleaning mode based on the calculated "residual toner" will be described.

TABLE 1

| Residual Toner Amount | | Rank |
|---|---|---|
| Not less than 0 mg | Less than 5 mg | A |
| Not less than 5 mg | Less than 50 mg | B |
| Not less than 50 mg | Less than 500 mg | C |
| Not less than 500 mg | | D |

TABLE 2

| Rank | Condition Example 1 Cleaning Process Time | Condition Example 2 Voltage (Absolute) | Condition Example 3 Voltage (Absolute)/ Processing time |
|---|---|---|---|
| A | Two rotation cycles | 2 kV | 2 kV/Two rotations |
| B | Four rotation cycles | 3 kV | 4 kV/Two rotations |
| C | Eight rotation cycles | 4 kV | 4 kV/Six rotations |
| D | Eight rotation cycles | 4 kV | 4 kV/Six rotations |

TABLE 2-continued

| Rank | Condition Example 1 Cleaning Process Time | Condition Example 2 Voltage (Absolute) | Condition Example 3 Voltage (Absolute)/ Processing time |
|---|---|---|---|
| Fixed condition | 2 kV | Four rotation cycles | — |

Table 1 shows ranks A-D, which are ranks of residual toner amount according to the calculated residual toner. Table 2 shows execution conditions of the cleaning modes, which is determined based on the ranks. In this embodiment, a toner amount per one dot for each color uses a prescribed value of 12.5 mg/Mdot (=7 g/m$^3$: 600 dpi). In this case, the residual toner 5 mg denotes that the image area ratio of the total image data of four colors corresponding to the image area is 1.1% under the condition that the image area corresponding to the differential distance Ld is one page of A4 size. In the case of residual toner 500 mg, similarly, it corresponds to 110%.

Table 2 shows the execution conditions of the cleaning mode corresponding to the rank determined based on the residual toner amount. Examples of condition shown in the example 1 in Table 2 show different cleaning process times as the execution conditions of the cleaning modes. Here, the cleaning process time denotes the time period, during which the alternative voltage is applied, as executed for a time period from time t4 to time t5 as illustrated in FIGS. 7(*a*)-7(*b*). In the examples shown in FIGS. 7(*a*)-7(*b*), the process time, which was eight rotation cycles is changed to two rotation cycles to eight rotation cycles based on the residual toner amount as shown in Table 2.

Examples shown in the condition example 2 show different voltages to be outputted from the high voltage source as execution condition of the cleaning modes. In the example shown in FIGS. 7(*a*)-7(*b*) shows the example having outputted absolute value 2 kV. This absolute output is changed to voltages of 2 kV-4 kV corresponding to the rank of the residual toner image. In this case, the rotation cycle is set at a constant condition of four rotation cycles.

The condition example 3 shown in Table 2 is an example of changing the cleaning process time and the voltage outputted from the high voltage source by combining them as the execution condition of the cleaning mode.

Back to the explanation of the control flow illustrated in FIG. 8. In STEP 25, the cleaning control section A16 executes the cleaning mode according to the condition determined in STEP S22.

In STEP 31, the image formation stopped by the controller A1 is restarted according to the cleaning mode. This image formation restart is not necessary to be held until the cleaning mode finishes. In case when restarting the image formation, which has been stopped, the controller A1 controls the timing of starting exposure so as to be the timing, at which the transfer to the sheet by the secondary transfer section is not executed, until the cleaning mode finishes. In other words, the image formation and the sheet conveyance are started in advance with the timing that the toner image on the transfer belt 6 and the sheet, onto which the toner image is transferred, arrive at the secondary transfer section 9 in the image formation, which will restart when the cleaning mode execution finishes. In this case, the sheet to be conveyed is the sheet, which has been in a waiting condition on a dual surface conveyance path under the condition that an image has been formed on one side of the sheet, due to the interruption of the image formation, or the sheet in the other sheet tray, which is a different sheet tray having sheet exhaustion.

As described above, it becomes possible to efficiently execute cleaning of a transfer roller by controlling the execution condition of the cleaning mode based on the toner amount calculated at the residual toner amount calculation section A15. Further, it becomes possible to obtain an image forming apparatus, which is capable of avoiding the inconvenience of the residual toner due to the sheet exhaustion of the sheet feed tray.

Other Embodiment

Figure 9:
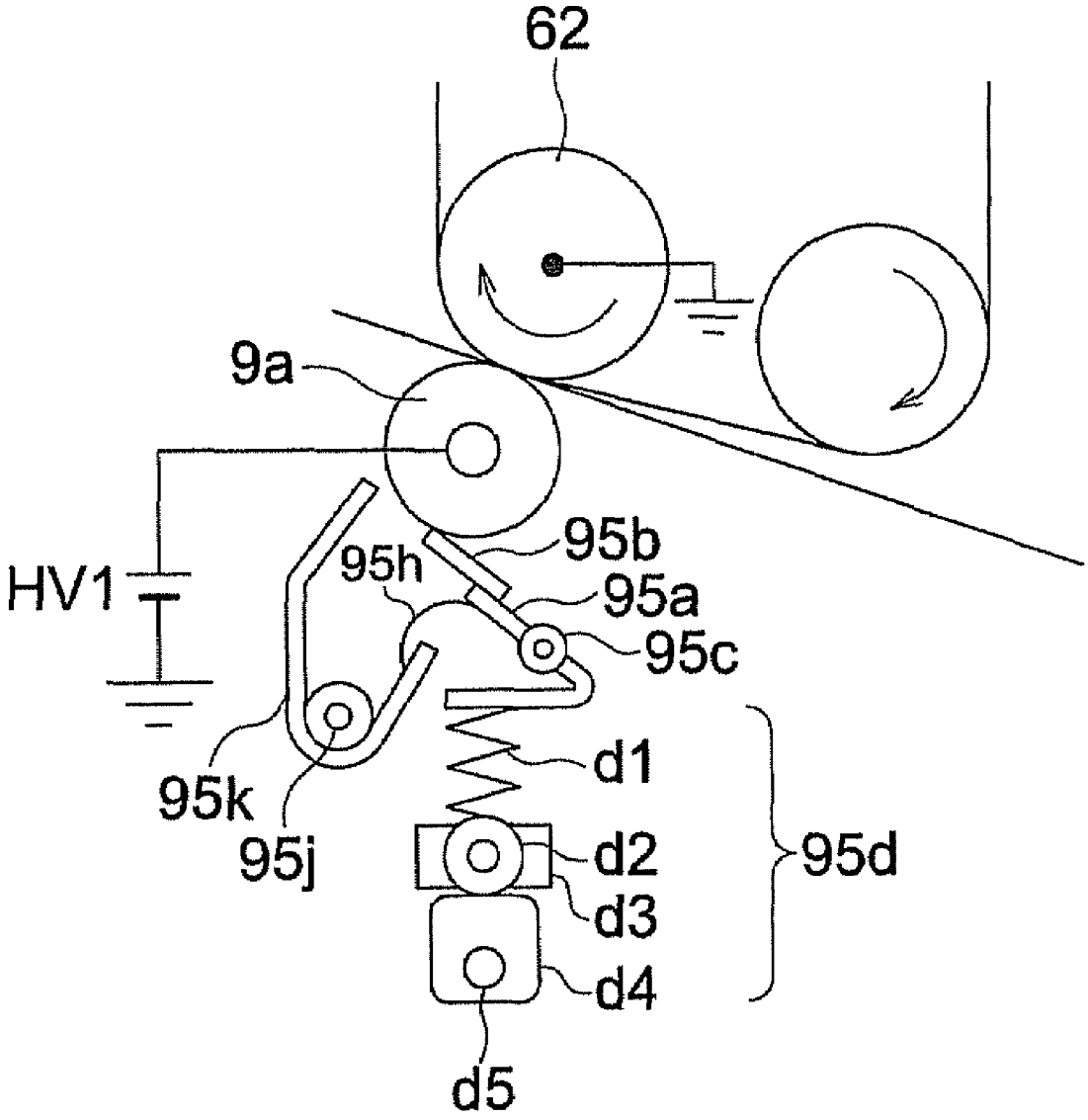
FIG. 9 illustrates a cleaning blade used as the other embodiment.

FIG. 9 illustrates the other embodiment using a cleaning blade as a cleaning system of the transfer roller. 95*b* denotes a cleaning blade. The material of the cleaning blade is urethane rubber having a free length of 9 mm and the thickness of 2 mm. The cleaning blade 95*b* is adhered onto one edge of a holding plate 95*a*. The holding plate 95*a* is arranged to rotate centering on a shaft 95*c*. The other edge of the holding plate 95*a* is pressed by a spring d1 and the cleaning blade 95*b* is arranged to rotate centering on the shaft 95*c* so that the cleaning blade 95*b* is pressed onto the secondary transfer roller 9*a*.

95*d* denotes a contact weight change section for changing the contact weight by moving up and down a moving member d3 supporting one edge of the spring d1. A cam shaft d5 is connected with a motor (not shown). The height of a bearing d2 changes according to the rotation of a cam d4, which rotates according to the rotation of the motor. An eccentric cam d4 fixed to the cam shaft d5, which is driven and rotated by the motor (not shown), moves the bearing d2 up and down to move a moving member d3 supporting the bearing d2. The holding plate 95*a* receives the force, which rotates centering on a shaft 95*c*, and the change of contact weight acting to the cleaning blade 95*b* is conducted by that the spring d1 held by the moving member d3 presses and moves one edge of the holding member 95*a* up and down. In this embodiment, in case when the moving member d3 is positioned at the highest position based on the rotation of the eccentric cam, the leading edge of the cleaning blade 95*b* touches the secondary transfer roller 9*a* and the contact weight reaches to 12-14 N/m as the maximum weight. On the other hand, in case when the moving member d3 is positioned at the lowest position, the pressing weight becomes close to zero as the minimum weight. In this case, the leading edge of the cleaning blade 95*b* becomes a state of light contact with the secondary transfer roller.

The toner scraped off by the cleaning blade 95*b* is conveyed by a conveyance screw 95*j* in the shaft direction in the rear side of FIG. 9. 95*h* denotes a thin sheet for protecting the scraped toner from splashing, which prevents the scraped toner from being spread out inside the apparatus together with a machine frame (not shown).

In the embodiment illustrated in FIG. 9, normally, the contact weight of the cleaning blade against the secondary transfer roller 9*a* is set at almost zero, which is in a light contact state. However, in the execution process of the cleaning mode (STEP 25 in FIG. 6), the cleaning mode will be executed with the maximum weigh by rotating the eccentric cam d4 for a time period equivalent to the two rotation cycles of the secondary transfer roller 9*a*.

As described above, effective cleaning, in which a cleaning process time has been reduced, becomes possible by using the cleaning blade 95*b*. Further, the lowering of productivity can be prevented and an image forming apparatus, which is capable of avoiding the inconvenience caused by residual toner associated with sheet exhaustion in a sheet tray, can be obtained.

According to the present invention, it becomes possible prevent lowering productivity and obtain an image forming apparatus, which is capable of avoiding the inconvenience caused by residual toner on an intermediate transfer member associated with sheet exhaustion in a sheet tray.

What is claimed is:

1. An image forming apparatus which forms a toner image on a sheet, comprising:

(a) a plurality of exposure sections each which imagewise exposes based on image data;

(b) a plurality of photoreceptors each for forming an electrostatic latent image by the imagewise exposure of the exposure section;

(c) an intermediate transfer member, onto which respective color toner images formed on the plurality of photoreceptors are transferred;

(d) a primary transfer section which executes a first transfer by superimposing respective color toner images formed on the plurality of photoreceptors onto the intermediate transfer member;

(e) a secondary transfer section including a transfer roller in contact with the intermediate transfer member, which concurrently transfers a plurality of toner images superimposed and formed on the intermediate transfer member onto a sheet conveyed from a sheet feed tray, the secondary transfer section and a high voltage power source which applies voltage to the transfer roller;

(f) a sheet feed tray including a sheet sensor which detects sheet exhaustion; and (g) a controller which judges whether there is residual toner, which is a toner image formed onto the intermediate transfer member but not transferred onto the sheet when the sheet sensor detects the sheet exhaustion, and executes a cleaning mode in which the transfer roller is cleaned when there is the residual toner.

2. The image forming apparatus of claim 1, wherein in the cleaning mode, the controller transfers the residual toner from the transfer roller to the intermediate member by controlling so that a bias voltage is applied to the transfer roller from the high voltage power source, thereby cleaning the transfer roller.

3. The image forming apparatus of claim 1, wherein the controller calculates the residual toner amount based on a distance Ld of a difference between L1 and L2 and the image data, and controls an execution condition of the cleaning mode when the sensor detects the sheet exhaustion, where L1 represents a distance between an exposure position on the photoreceptor and a position of the secondary transfer section through the primary transfer section, and L2 represents a distance between a leading edge of sheets stored in the sheet feed tray and the position of the secondary transfer section.

4. The image forming apparatus of claim 2, wherein in the cleaning mode, the controller controls the high voltage power source so that value of at least one of a voltage and a current of a bias to be applied to the transfer roller, is changed.

5. The image forming apparatus of claim 2, wherein in the cleaning mode, the controller applies a bias voltage having an alternate voltage to the transfer roller.

6. The image forming apparatus of claim 1, wherein the controller changes a cleaning processing period of time as an execution condition of the cleaning mode.

7. The image forming apparatus of claim 1, wherein when image formation which has been stopped is restarted, the controller controls the imagewise exposure of the exposure section so that a toner image is not transferred by the secondary transfer section onto a sheet after the image formation until the execution of the cleaning mode is completed.

* * * * *